US007803260B2

(12) United States Patent
Hashimoto et al.

(10) Patent No.: US 7,803,260 B2
(45) Date of Patent: Sep. 28, 2010

(54) OXYGEN EVOLUTION ELECTRODE

(75) Inventors: Koji Hashimoto, Miyagi-ken (JP); Ahmed Abd El-Moneim, Giza (EG); Naokazu Kumagai, Chiba-ken (JP)

(73) Assignees: Daiki Ataka Engineering Co., Ltd., Tokyo (JP); Koji Hashimoto, Sendai (JP)

( * ) Notice: Subject to any disclaimer, the term of this patent is extended or adjusted under 35 U.S.C. 154(b) by 511 days.

(21) Appl. No.: 11/976,512

(22) Filed: Oct. 25, 2007

(65) Prior Publication Data

US 2008/0116065 A1 May 22, 2008

(30) Foreign Application Priority Data

May 9, 2006 (JP) ..... 2006-130890

(51) Int. Cl.

| | |
|---|---|
| ***C25B 11/16*** | (2006.01) |
| ***C25B 11/04*** | (2006.01) |
| ***C25B 11/06*** | (2006.01) |
| ***C25B 11/08*** | (2006.01) |

(52) U.S. Cl. ..... 204/290.13; 204/290.01; 204/290.03; 204/290.06; 204/290.08; 204/290.09; 204/290.12; 204/290.14

(58) Field of Classification Search ..... 204/290.01, 204/290.03, 290.06, 290.08, 290.09, 290.12, 204/290.13, 290.14

See application file for complete search history.

(56) References Cited

U.S. PATENT DOCUMENTS

| | | | | |
|---|---|---|---|---|
| 4,285,799 | A * | 8/1981 | de Nora et al. | 204/290.09 |
| 4,289,591 | A * | 9/1981 | Davidson et al. | 205/634 |
| 2008/0035491 | A1* | 2/2008 | Ohta et al. | 205/551 |
| 2008/0116065 | A1* | 5/2008 | Hashimoto et al. | 204/290.13 |
| 2008/0149476 | A1* | 6/2008 | Hashimoto et al. | 204/290.12 |

* cited by examiner

*Primary Examiner*—Bruce F Bell
(74) *Attorney, Agent, or Firm*—Edwards Angell Palmer & Dodge LLP

(57) ABSTRACT

Disclosed is an oxygen evolution electrode for formation of only oxygen without formation of chlorine at anode in the performance and the durability of the anode is so high that they are, even in strong acid, at the same level as that in neutral solution. The electrode is prepared by anodic deposition of multiple oxide consisting of Mn—Mo—Sn, Mo—W—Sn or Mn—Mo—W—Sn on an IrO2-coated titanium substrate. The multiple oxide are composed of Mn as the main component, 0.1-3 cationic % of Sn and 0.2-20 cationic % of Mo and/or W.

2 Claims, No Drawings

OXYGEN EVOLUTION ELECTRODE

BACKGROUND OF THE INVENTION

1. Field in the Industry

The present invention concerns an anode for oxygen evolution without forming chlorine in electrolysis of chloride-containing aqueous solutions including seawater.

2. Prior Art

In general, seawater electrolysis is performed to produce sodium hypochlorite by the reaction of chlorine formed on the anode with sodium hydroxide formed on the cathode in addition to the formation of hydrogen on the cathode. For this purpose, there has been used anodes made by coating titanium with an oxide or oxides of an element or elements of the platinum group (hereinafter referred to as "platinum group element(s)") as the high performance electrodes.

On the other hand, like fresh water electrolysis to produce hydrogen and oxygen, for production of hydrogen and oxygen in seawater electrolysis, formation of hydrogen on the cathode and formation of oxygen on the anode without formation of chlorine are prerequisite, and hence, a special anode is required.

The inventors found the fact that the oxide electrode prepared by repeated coating of Mn salt solution together with Mo salt and/or W salt on a conducting substrate and subsequent calcination at high temperatures in air was active as an anode for oxygen evolution in electrolysis of sodium chloride solutions but inactive for chlorine evolution, and disclosed it (Japanese Patent Disclosure No. 09-256181). There are two types in this kind of electrodes:

(1) The electrode in which the conducting substrate is coated with the oxide containing 0.2-20 cationic % of Mo and/or W and the balance of Mn as the main cation.

(2) The electrode in which the conducting substrate is coated with the oxide containing 0.2-20 cationic % of Mo and/or W, 1-30 cationic % of Zn, and the balance of Mn as the main cation, and in which the effective surface area is increased by leaching out of Zn by immersion in a hot concentrated alkali solution.

The above-explained previous invention is based on the findings that, in production of oxygen evolution anode, calcination of Mn salt coated on the conducting substrate leads to formation of $Mn_2O_3$ and that inclusion of Mo and/or W in $Mn_2O_3$ enhances the oxygen evolution efficiency. In production of the oxygen evolution anode, if the calcination temperature is not sufficiently high, the stability of the electrode is insufficient due to insufficient crystal growth, but even at high temperatures Mn cannot be oxidized to the higher valence than three because of decomposition of high valent Mn compositions.

Nevertheless, the higher valence Mn oxide was expected to have the higher activity for oxygen evolution. Thus, Mn oxide formation was tried by anodic deposition from divalent Mn salt solution instead of calcination and a highly active anode consisting of tetravalent Mn was obtained. This finding was also disclosed (Japanese Patent Disclosure No. 10-287991). The method is novel in that anodic deposition is applied for production of this electrode consisting of the conducting substrate coated with the oxides containing 0.2-20 cationic % of Mo and/or W, and the balance of Mn as the main cation.

Subsequently, the inventors made the following inventions and the inventions were disclosed. They concern the electrolytic cell using the above-described anode (Japanese Patent Disclosure No. 11-256383), the electrode assembly using combination of the electrode and a diode (Japanese Patent Disclosure No. 11-256384), and a method of producing the anode (Japanese Patent Disclosure No. 11-256385). Furthermore, the inventors found that the electrode in which Fe is added to Mn—Mo, Mn—W or Mn—Mo—W oxides was effective as the oxygen evolution anode in the solutions containing chloride ion in a wide temperature range up to just below the boiling point of water (Japanese Patent Disclosure No. 2003-19267). Another patent application was filed for the modified technology of producing the anode including the preparation method of the titanium substrate (Japanese Patent Disclosure No. 2007-138254).

A common problem of oxygen evolution anodes is deterioration by prolonged operation. Insufficient adhesion of electrocatalyst to the substrate of the electrode leads to peeling off of the electrocatalyst due to high pressure of violently evolving oxygen gas. Furthermore, insufficient activity of electrocatalyst for oxygen evolution results in increase in electrode potential during oxygen evolution at a constant current density with a consequent acceleration of electrode deterioration due to formation of insulating titanium oxide. Thus, the stable anode on which oxygen evolution steadily occurs for a long period of time without deterioration of electrode during electrolysis of solutions containing chloride ion has been strongly demanded. Another requirement of oxygen evolution anode is high stability without degradation even if the anode is used in a wide pH range including a strong acidic condition.

SUMMARY OF THE INVENTION

The main object of this invention is to provide an oxygen evolution anode capable of producing oxygen for a long period of time in electrolysis of aqueous solutions containing chloride ion, and in particular, to provide the stable electrocatalyst oxide at high anodic polarization potentials forming oxygen without forming chlorine.

The above-mentioned object can be accomplished by using the electrocatalyst consisting of multiple oxide containing Mn as the main component with Mo and/or W and a certain amount of Sn. The oxygen evolution anode of the present invention is prepared by anodic deposition of multiple oxide containing Mn as the main component with 0.2-20 cationic % of Mo and/or W and 0.1-3 cationic % of Sn, and is used for oxygen evolution in electrolysis of aqueous solutions containing chloride ion.

DETAILED EXPLANATION OF THE PREFERRED EMBODIMENTS

A preferable method for production of oxygen evolution anode according to the present invention is as follows: Corrosion resistant titanium or titanium alloys are used as material of the conducting substrate for the electrode. If the electrocatalyst is directly prepared on the titanium substrate the insulating $TiO_2$ film is formed during electrolysis, and hence, the life of the electrode will be short. For prevention of the insulating $TiO_2$ film formation, an $IrO_2$ coating as the intermediate layer is prepared so as to avoid direct contact of titanium with seawater. For this purpose, conversion of Ir salt to Ir oxide can be carried out by repetition of coating of the titanium substrate with Ir chloride-butanol solution of designated concentration and subsequent drying and heating at 450° C., and by final calcination in air at 450° C. for about 1 hour. The $IrO_2$ coated titanium thus prepared is used as the substrate for anodic deposition of the electrocatalyst.

The formation of electrocatalyst by anodic deposition can be carried out on the thus prepared substrate in the heated $MnSO_4$—$SnCl_4$ solution with $Na_2MoO_4$ and/or $Na_2WO_4$, the pH of which is adjusted by addition of sulfuric acid. The oxygen evolution electrode, the electrocatalyst of which is multiple oxide of Mn—Mo—Sn, Mn—W—Sn or Mn—Mo—W—Sn, is thus formed.

The reasons why the composition of the multiple oxide electrocatalyst is defined as described above are as follows:

Mn is the basic component of the multiple oxide electrode of the present invention and forms $MnO_2$ which acts to form oxygen in seawater electrolysis.

Mo and W themselves do not form oxides with sufficiently high activity for oxygen evolution, but the coexistence with $MnO_2$ prevents chlorine evolution and enhances oxygen evolution in addition to prevention of oxidation of Mn to soluble permanganate ion. This effect cannot be obtained unless at least 0.2 cationic % of Mo and/or W are contained in the multiple oxide. However, the excess addition of Mo and/or W decreases the oxygen evolution efficiency, and hence, the cationic % of Mn and/or W must be 20 or less.

Sn increases oxygen evolution activity and durability by constituting multiple oxide with Mn and W and/or Mo. This effect appears with the addition of 0.1 cationic % or more of Sn, and is enhanced with an increase in Sn content. However, the excess addition of Sn rather decreases the oxygen evolution efficiency, and hence, the maximum content of Sn, 3 cationic %, is set.

The oxygen evolution electrode of the present invention characterized by composition and preparation method exhibits high performance for oxygen evolution without chlorine formation. In particular, in acidic solution the characteristics of oxygen evolution and durability of the anode are not inferior to those in the neutral solution.

EXAMPLES

Example 1

To a mixed solution of 0.2 M $MnSO_4$-0.003 M $Na_2MoO_4$-0.006 M $SnCl_4$ sulfuric acid was added to adjust the pH to −0.1, and the solution was warmed to 90° C. The anodic deposition was carried out in the above mixed solution as the electrolytic solution on an $IrO_2$-coated titanium substrate anode at 600 A/m$^2$ for 60 min. The cationic composition of the deposit obtained by EPMA was 92.2% Mn-7.1% Mo-0.6% Sn. X-ray diffraction revealed that the deposit thus formed was a single phase $MnO_2$ type oxide including Mo and Sn. XPS analysis showed that the cations in the electrodeposit oxide were $Mn^{3+}$, $Mn^{4+}$, $Mo^{6+}$ and $Sn^{4+}$. Consequently, the electrocatalyst of the oxygen evolution anode was composed of a single phase triple oxide of Mn—Mo—Sn—O.

Using the electrode thus prepared the electrolysis was carried out in 0.5 M NaCl solution of pH 8.7 (weakly alkaline) and at pH 2.0 (strongly acidic) at 1000 A/m$^2$ for 1000 Coulombs, and then the chlorine evolution efficiency was analyzed by iodimetric titration.

In the electrolysis of either solution of weak alkali or strong acid, no chlorine evolution was detected with a consequent 100% oxygen evolution efficiency.

After electrolysis for 7000 hours in the weak alkali the oxygen evolution efficiency was higher than 98%, and after electrolysis for 4000 hours in the strong acid the oxygen evolution efficiency was also higher than 98%.

Consequently, it was ascertained that the electrode of the present invention has the high activity for oxygen evolution and the excellent durability even in electrolysis of strong acid of low pH.

Example 2

The anodic deposition for 20 min. was carried out two or three times on the $IrO_2$-coated titanium substrate anodes at 90° C. and 600 A/m$^2$ in mixed solutions of various concentrations of $MnSO_4$, $Na_2MoO_4$ and $SnCl_4$. Before each deposition the electrolyte solution was renewed. The Mn—Mo—Sn—O type anodes with various compositions were thus obtained. XPS analysis showed that the cations in the electrodeposited oxides were $Mn^{3+}$, $Mn^{4+}$, $Mo^{6+}$ and $Sn^{4+}$. Cationic compositions of the electrodes thus prepared were analyzed by EPMA.

Using the electrodes thus prepared the electrolysis was carried out in 0.5 M NaCl solutions of pH 8.7 and pH 2.0 at 1000 A/m$^2$ for 1000 Coulombs, and then the oxygen evolution efficiency was obtained from the difference between the amount of charge passed and that of chlorine formation obtained by iodimetric titration. The results obtained are shown in Table 1. Table 1 shows that the electrodes of the present invention have excellent characteristics in electrolysis of both strongly acidic and weakly alkaline solutions containing chloride.

TABLE 1

| | Cationic % of cations in oxide deposits | | | Oxygen evolution efficiency (%) | |
|---|---|---|---|---|---|
| | Mn | Mo | Sn | pH 7.8 | pH 2.0 |
| Electrodes of the present invention | 99.7 | 0.2 | 0.1 | 97.6 | 97.4 |
| | 90.5 | 9.1 | 0.4 | 100.0 | 100.0 |
| | 89.8 | 9.7 | 0.5 | 100.0 | 100.0 |
| | 92.3 | 7.1 | 0.6 | 100.0 | 100.0 |
| | 93.9 | 5.3 | 0.8 | 100.0 | 100.0 |
| | 87.4 | 11.4 | 1.2 | 100.0 | 100.0 |
| | 90.5 | 8.1 | 1.4 | 100.0 | 100.0 |
| | 87.5 | 9.7 | 2.8 | 100.0 | 100.0 |
| | 84.3 | 12.9 | 2.8 | 100.0 | 100.0 |
| | 80.1 | 17.0 | 2.9 | 100.0 | 100.0 |
| | 86.3 | 10.7 | 3.0 | 99.9 | 99.9 |
| | 88.7 | 8.3 | 3.0 | 99.8 | 99.7 |
| Control Example | 91.7 | 4.2 | 4.1 | 95.2 | |

Example 3

The anodic deposition was carried out on the $IrO_2$-coated titanium substrates as the anodes at 90° C. and 600 A/m$^2$ for 60 min. in the solutions of various concentrations of $MnSO_4$, $Na_2WO_4$ and $SnCl_4$, and the Mn—W—Sn—O type anodes with various compositions were obtained. XPS analysis showed that the cations in the electrodeposited oxides were $Mn^{3+}$, $Mn^{4+}$, $W^{6+}$ and $Sn^{4+}$. Cationic compositions of the electrodes thus formed were analyzed by EPMA.

Using the electrodes thus prepared the electrolysis was carried out in 1 litter of 0.5 M NaCl solution of pH 8.7 and pH 2.0 at 90° C. and 1000 A/m$^2$ for 1000 Coulombs, and then, the oxygen evolution efficiency was obtained from the difference between the amount of charge passed and that of chlorine formation obtained by iodimetric titration. The results obtained are shown in Table 2. Table 2 shows that the electrodes of the present invention have excellent characteristics in electrolysis of both strongly acidic and weakly alkaline solutions containing chloride.

TABLE 2

| | Cationic % of cations in oxide deposits | | | Oxygen evolution efficiency (%) | |
|---|---|---|---|---|---|
| | Mn | W | Sn | pH 7.8 | pH 2.0 |
| Electrodes of the present invention | 99.7 | 0.2 | 0.1 | 97.6 | 97.4 |
| | 99.8 | 0.1 | 0.1 | 98.0 | 97.8 |
| | 89.7 | 9.9 | 0.4 | 100.0 | 100.0 |
| | 89.8 | 9.7 | 0.5 | 100.0 | 100.0 |
| | 93.4 | 6.0 | 0.6 | 100.0 | 100.0 |
| | 93.8 | 5.4 | 0.8 | 100.0 | 100.0 |
| | 85.8 | 13.0 | 1.2 | 100.0 | 100.0 |
| | 89.4 | 9.2 | 1.4 | 100.0 | 100.0 |
| | 87.5 | 9.9 | 2.6 | 100.0 | 100.0 |
| | 82.1 | 15.1 | 2.8 | 100.0 | 100.0 |
| | 80.3 | 16.8 | 2.9 | 100.0 | 100.0 |
| | 86.9 | 10.1 | 3.0 | 99.7 | 99.7 |
| | 89.7 | 7.3 | 3.0 | 99.6 | 99.5 |
| Electrodes of the Control Example | 92.0 | 3.8 | 4.2 | 94.8 | |

Example 4

The anodic deposition for 20 min. was carried out two or three times on the $IrO_2$-coated titanium substrate at 90° C. and 600 A/m$^2$ in the mixed solutions of various concentrations of $MnSO_4$, $Na_2MoO_4$, $Na_2MoO_4$ and $SnCl_4$. Before each deposition the electrolyte solution was renewed. The Mn—Mo—W—Sn—O type anodes with various compositions were thus obtained. XPS analysis showed that the cations in the electrodeposit oxides were $Mn^{3+}$, $Mn^{4+}$, $Mo^{6++}$, $W^{6+}$ and $Sn^{4+}$. Cationic compositions of the electrodes thus formed were analyzed by EPMA.

Using the electrodes thus prepared the electrolysis was carried out in 1 liter of 0.5 M NaCl solution of pH 8.7 and 2.0 at 90° C. and 1000 A/m$^2$ for 1000 Coulombs, and then the oxygen evolution efficiency was obtained from the difference between the amount of charge passed and that of chlorine formation obtained by iodimetric titration. The results obtained are shown in Table 3. Table 3 shows that the electrodes of the present invention have excellent characteristics in electrolysis of both strongly acidic and weakly alkaline solutions containing chloride.

TABLE 3

| | Cationic % of Cations in Oxide Deposits | | | | Oxygen Evolution Efficiency (%) | |
|---|---|---|---|---|---|---|
| | Mn | Mo | W | Sn | pH 7.8 | pH 2.0 |
| Electrodes of the present invention | 99.7 | 0.15 | 0.05 | 0.1 | 97.6 | 96.8 |
| | 98.7 | 9.2 | 2.8 | 0.2 | 100.0 | 99.9 |
| | 86.8 | 6.4 | 6.5 | 0.3 | 100.0 | 100.0 |
| | 88.0 | 2.4 | 9.2 | 0.4 | 100.0 | 100.0 |
| | 86.7 | 7.5 | 5.3 | 0.5 | 100.0 | 100.0 |
| | 84.6 | 6.7 | 8.1 | 0.6 | 100.0 | 100.0 |
| | 80.8 | 10.1 | 8.4 | 0.7 | 100.0 | 100.0 |
| | 81.7 | 12.3 | 4.5 | 1.5 | 100.0 | 100.0 |
| | 86.2 | 9.8 | 2.2 | 1.8 | 100.0 | 100.0 |
| | 84.8 | 6.3 | 6.4 | 2.5 | 100.0 | 100.0 |
| | 91.0 | 2.4 | 4.1 | 2.5 | 99.7 | 99.8 |
| | 84.2 | 5.6 | 7.5 | 2.7 | 100.0 | 100.0 |
| | 90.6 | 2.7 | 3.8 | 2.9 | 99.4 | |
| Electrodes of the Control Example | 95.3 | 0 | 0 | 4.7 | 93.5 | |

We claim:

1. An oxygen evolution electrode for electrolysis of aqueous solutions containing chloride ion, wherein the electrode is prepared by anodic deposition of multiple oxide consisting of 0.1-3 cationic % of Sn, 0.2-20 cationic % of Mo and/or W, and the balance of Mn, on a conducting substrate made of titanium.

2. The oxygen evolution electrode according to claim 1, wherein the conducting substrate made of titanium is coated with $IrO_2$ prior to the electrodeposition of the multiple oxide.

* * * * *